United States Patent [19]

Crepeau et al.

[11] 4,112,265

[45] Sep. 5, 1978

[54] ROTATABLE CAM LIMIT SWITCH WITH VARIABLE TIMING AND DWELL

[75] Inventors: Robert G. Crepeau; Thomas G. Karakis, both of Greendale, Wis.

[73] Assignee: Allen-Bradley Company, Milwaukee, Wis.

[21] Appl. No.: 772,707

[22] Filed: Feb. 28, 1977

[51] Int. Cl.[2] ..... H01H 19/00; H01H 3/16

[52] U.S. Cl. ..... 200/31 R; 200/38 E; 200/47; 200/153 L

[58] Field of Search.....200/17 R–38 E, 200/38 BA, 38 C, 38 CA, 38 E, 47, 153 L, 153 LB, 153 T

[56] References Cited

U.S. PATENT DOCUMENTS

| | | | |
|---|---|---|---|
| 2,563,304 | 8/1951 | Bjork | 200/38 C X |
| 2,791,656 | 5/1957 | Dehn et al. | 200/16 A |
| 3,465,269 | 9/1969 | Hendershot | 200/38 E X |

*Primary Examiner*—James R. Scott

*Attorney, Agent, or Firm*—Arnold J. Ericsen

[57] ABSTRACT

A rotatable cam limit switch with a switch operating cam mounted directly on a continuously rotating drive shaft and axially shiftable relative to the shaft. The drive shaft is also provided with a "fast thread" for adjustable axial positioning of a timing element in slidable engagement with the cam. Manual axially adjustable yoke elements respectively engage the cam and timing element for establishing preselected switch dwell time and phase relationship between said switch and said shaft.

11 Claims, 3 Drawing Figures

ROTATABLE CAM LIMIT SWITCH WITH VARIABLE TIMING AND DWELL

BACKGROUND OF THE INVENTION

This invention relates generally to continuously rotating limit switches; and, more particularly, to a switch used in connection with machines having repetitive cycle of operation, in which use this limit switch renders possible the opening and closing of independent circuits at any desired angular position, and keeping these circuits open or closed for practically any desired angular travel.

Switches of the present type have a wide application in programming and time-sequence operations. They are commonly used on power-presses and similar machinery, where a speed change, or even a complete stoppage or reversal of the part or all of the machinery, is required of certain positions of the main drive.

Most of the prior art switches comprise juxtaposed adjustable disc-like cams mounted on and rotatable with a rotating shaft, the lobe or lobes or each cam making contact at various stages of rotation with an independent roller-type contact unit. Quite complex and expensive devices have been developed through the years for adjusting the angular position and angular size of a particular cam lobe.

Examples of the type of switches involving the field of this invention are illustrated in U.S. Pat. No. 2,903,528 granted to E. H. Kuhn assigned to the assignee of the present invention and recent developments, such as those disclosed in U.S. Pat. Nos. 3,465,269 and 3,721,780 granted to R. V. Hendershot and to R. R. Kelly et al, respectively.

Certain prior art devices which provide both timing and dwell features require a plurality of parallel shafts for supporting and adjusting switch components. It will be apparent that efforts to minimize the number of parts will also minimize the adverse affects of improper alignment between the shafts and between the various members, such as cooperating worm gears. Also, a reduction of parts reduces costs, friction and free play of the cooperating elements comprising the switch assembly.

The present invention contemplates the achievement of the various functions of the prior art, but in a relatively simplified device using a minimum of parts, which in turn provide a minimal amount of friction and free play, as well as material reduction of cost.

SUMMARY OF THE INVENTION

The rotatable cam limit switch of this invention is useful for varying "on" and "off" time of an electrical switch or switches and for varying or regulating the point in time in which selected operating conditions occur. The assembly includes a drive shaft which may be threaded with a so-called "fast threaded" portion, or which shaft may support a molded member containing the desired thread. A timing adjust sleeve is disposed circumjacent to the drive shaft and threadingly engages the threaded portion of the drive shaft for axial adjustment relative to the shaft. An elongated, generally cylindrical, tubular cam member is provided for operating an electric switch or switches responsive to the movement of an associated cam follower. The cam member includes a through bore arranged to slidably receive the external surface of the timing adjust sleeve. Means, such as mating non-circular surfaces, are provided for preventing relative rotation between the sleeve and the cam in order to permit the cam to rotate concurrently with the sleeve as the shaft rotates.

Both the timing adjust sleeve and the cam preferably include laterally extending yoke members slidably engaging the respective sleeve and cam and arranged to be manually, longitudinally moved to adjust the axial position of the respective sleeve and cam while the drive shaft is in motion. The yoke members further serve to respectively retain the sleeve and cam in the desired adjusted position.

BRIEF DESCRIPTION OF THE DRAWINGS

Reference is now made to the description of the preferred embodiment, illustrated in the accompanying drawings, in which.

DESCRIPTION OF THE PREFERRED EMBODIMENT

Figure 1:
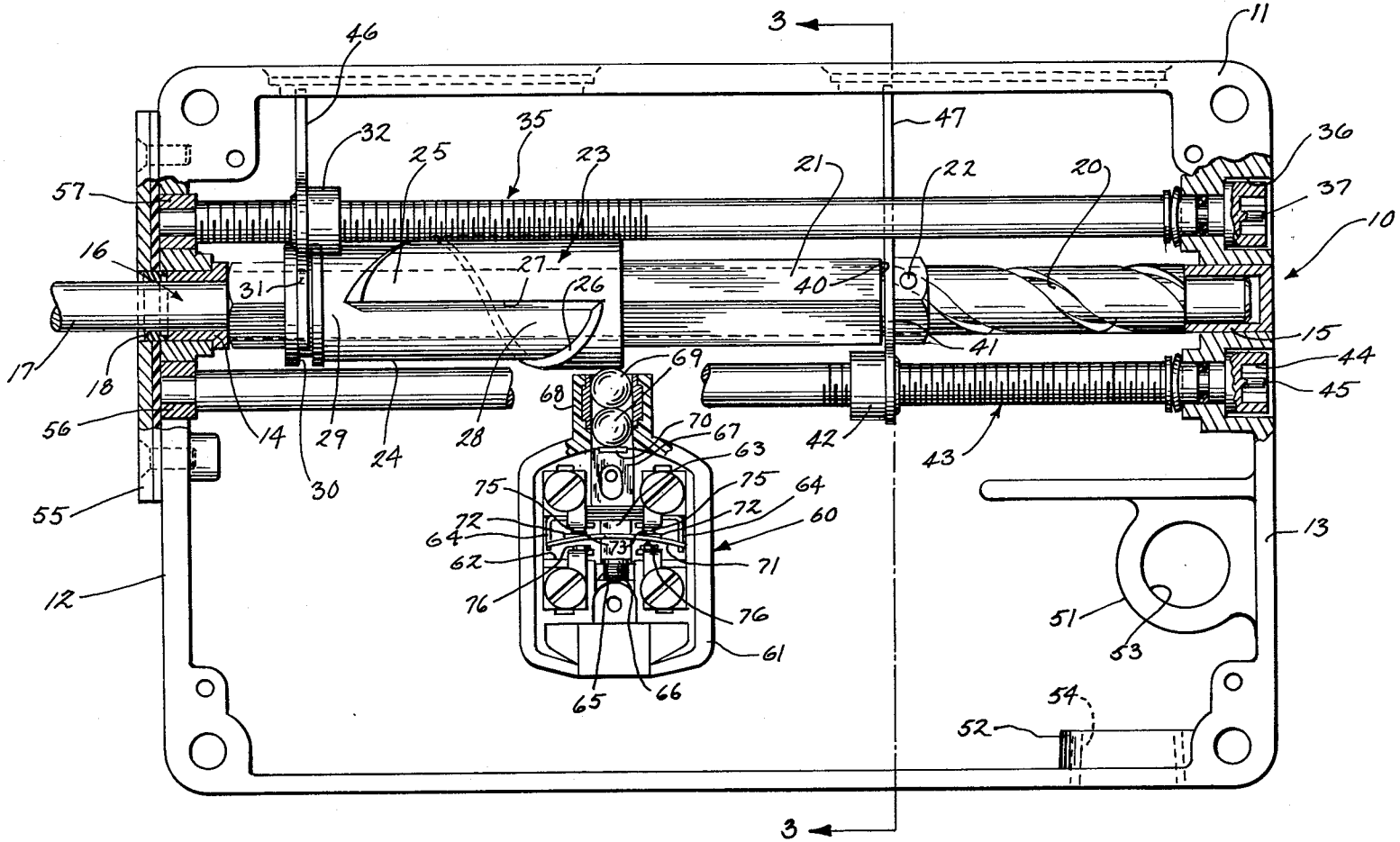
FIG. 1 is a side elevational view of a rotatable cam limit switch according to this invention showing the housing thereof with the cover removed to illustrate the general arrangement of elements therein.

The rotatable cam limit switch of the present invention is indicated generally by the numeral 10 and comprises an enclosure or housing 11 which supports and protects the entire mechanism.

The housing 11 is preferably of a die-cast metallic construction defining opposed supporting sidewalls 12 and 13 including openings for receiving oil-impregnated, sintered bushings 14 and 15 for supporting an input or drive shaft 16. The external portion 17 is sealed at its entrance into the enclosure 11 with an elastomeric lip-type shaft seal 18.

The input or drive shaft 16 is provided for at least a portion thereof with a "fast thread" or "fast traverse" portion 20 which can be integral with the shaft, or can be a thermoplastic molding pressed on and locked to the shaft, or it can be a formed metal tube, pressed on or locked to the shaft.

A timing adjust sleeve 21 comprising a metallic tubular member defining a hexagonal outer surface (see FIG. 3) with a bore containing thread-engaging means, such as a pin 22 forced into a transverse opening in the sleeve 21, or may take the form of "fast thread" machined internally of the bore of the sleeve 21 (not shown) for engagement with the threaded portion 20. One form of "fast thread" which may be used has 1.80 inches pitch for every 360°, i.e., the sleeve will traverse 1.8 inches between centers of each spiral convolution.

The operating cam 23 is tubular and includes a bore having an internal hexagonal shape to permit a slip-fit over the timing adjust sleeve 21. Thus, the cam is free to slide longitudinally relative to the sleeve 21 and arranged to rotate therewith. It should be noted that although the external surface of the sleeve 21 and the internal surface of the cam 23 are shown in their best mode as hexagonal, actually any contour permitting relative slidable motion between the parts, and yet retaining a non-rotational relationship between the parts, will work satisfactorily. For instance, although not shown, the external surface of the sleeve 21 may be provided with at least one longitudinal groove arranged to slidably receive an inwardly extending tang portion on the external surface of the cam 23; or the groove or grooves may be formed internally of the bore of the cam 23 and engage an upright pin or flanged tongue on the sleeve, if so desired.

Figure 3:
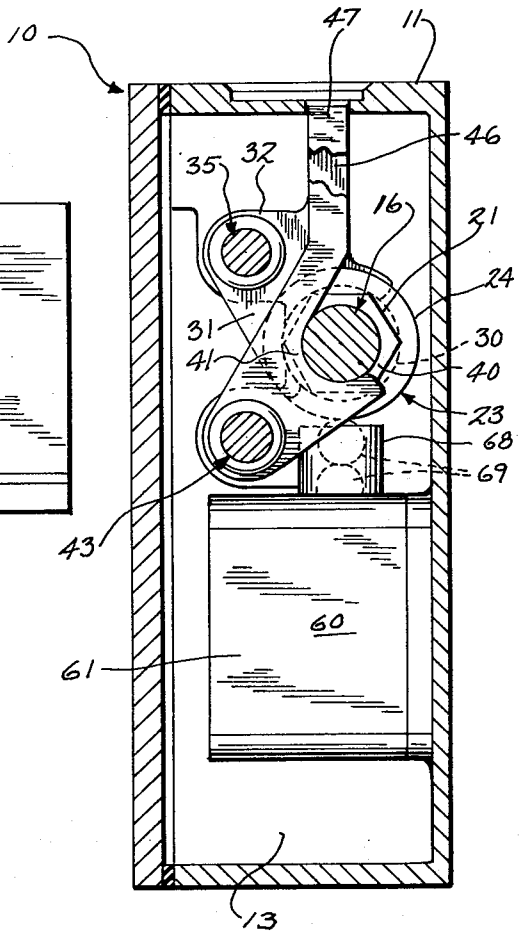
FIG. 3 is a cross-sectional view taken along lines 3—3 of FIG. 1.

The operating cam 23 may be a glass-reinforced, self-lubricating thermoplastic molding, or it may be of a sintered metal compression molding. The external surface of the cam 23 is similar to the surface described in the cam of U.S. Pat. No. 3,465,269 issued to Hendershot. That is, as illustrated in FIGS. 1 and 3, the cam 23 is formed as a generally cylindrical member having a cylindrical body portion 24 providing an elongated raised node or land portion 25 formed integrally with body portion 24. Land portion 25 projects outwardly of the circumference of the body portion 24 with its exterior defining a cylindrical segment providing a raised camming surface; the lesser diametered exterior surface of body portion 24 also constituting a cylindrical segment forming a depressed camming surface 29. The raised cam surface of portion 25 is uniform in diameter and triangular in shape. If represented in a developed plane, portion 25 would appear as right triangular surface, the base of the right-hand end of the cam 23 and the hypotenuse of which comprises an elongated riser 26 extending spirally around the cylindrical body portion 24. The leg of such triangular surface also constitutes a linear riser, indicated at 27 which extends generally parallel to the lengthwise axis of the cam 23. In a similar fashion, the cylindrical exterior of the body portion 24 not occupied by raised land portion 25, constitutes a depressed cam surface 28, bounded by the two riser portions 26 and 27 and the left-hand end of the cam as seen in FIG. 1. In general, it may be stated that the cam 23 constitutes a more or less cylindrical member having a spiral riser extending between a depressed cylindrical surface segment and a raised cylindrical surface segment thereof with such surface segments if developed in a plane, being configured generally as triangular.

At the left-hand end of the cam 23, as viewed in FIG. 1, there is provided a kerf or annular groove 30 which receives and cooperates with the outer ends of a bifurcated arm portion 31 of a shifting yoke member 32. The yoke portion 32 is internally threaded to receive the threaded portion of the dwell adjust shaft 35. The shaft 35 is headed at the right-hand end, as viewed in FIG. 1, to provide a tamper-proof style of hexagonal socket 36 for manual adjustment with a special mating wrench (not shown). For instance, the socket 36 of the preferred embodiment includes an upstanding pin 37 which will provide interference means for preventing the entrance of the usual "Allen" style wrench. The adjustment wrench (not shown) is of hardened steel including a reentrant hole for receiving the pin 37. Thus, only the "setup man" or other authorized personnel having the special wrench would be free to make the adjustment. It is within the province of the present invention, however, to provide plastic manually operated adjustment knobs (not shown), or other means of manual adjustment, such as knurling the ends of the shaft, if so desired.

As viewed in FIG. 1, it will be noted that the timing adjust sleeve 21 also includes a kerf or annular groove 40 for receiving the bifurcated arm portion 41 of the yoke 42. The yoke 42 is internally threaded to receive the threaded portion of the timing adjust shaft 43. The shaft 43 is terminated at its right end, as viewed in FIG. 1, in the same manner as the shaft 35. That is, this shaft also includes a hex socket portion 44 with an upstanding pin 45 for manual adjustment of the shaft 43. The yokes 32 and 42 each include laterally extending pointer arm portions 46 and 47, respectively.

Figure 2:
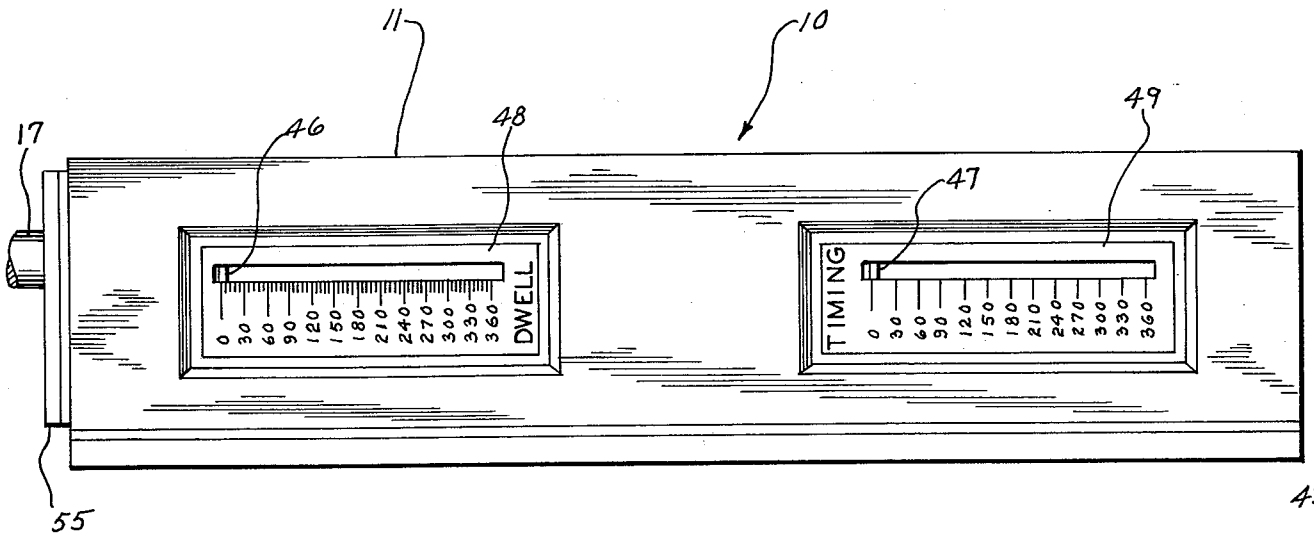
FIG. 2 is a top plan view of the device illustrated in FIG. 1.

It will be observed from FIGS. 1 and 2 that the housing or enclosure 11 includes at its upper surface, as viewed in FIG. 1, spaced openings for receiving dwell position and timing position scale means 48 and 49, respectively. It will be further observed from FIG. 2 that the distal ends of the respective pointer portions 46 and 47 may be viewed through the scales 48 and 49, respectively, to indicate the position of the cam 23 and the timing adjust sleeve 21. The scale assemblies 48 and 49 each consist of metal, plastic or glass printed scales and a glass or protective window. The pointer arm portions 46 and 47, in conjunction with the scales 48 and 49, serve as a setting index for the timing and dwell of the subject device.

The enclosure or housing 11 is cast to provide internal raised embossments 51 and 52 which are tapped to provide two conduit entrances 53 and 54. A removable front bearing plate 55 is die cast to provide bushing seats 56 and 57 for supporting the timing adjust shaft and the dwell adjust shaft, respectively.

Any of the several types of switch modules may be used for operation by the rotating cam 23. For instance, a precision switch having a moment arm for supporting a cam at one end and actuating a switch operator at its opposite end, similar to that shown in the Hendershot U.S. Pat. No. 3,465,269 may be used. However, the present invention contemplates the use of a snap action, double toggle, electric switch indicated generally by the numeral 60, and of the type shown and described in U.S. Pat. No. 2,791,656, issued to William F. Dehn and Roy E. Wilson, for "Contact Actuating Quick Action Switch" and assigned to the assignee of the present invention. Only so much of the structure and operation of the switch 60 will be described as is necessary for an understanding of the present invention, and attention is drawn to the Dehn et al patent for a full description of the switch.

The toggle switch comprises an insulating molded housing 61 defining a central cavity 62 within which there is disposed a reciprocally movable carrier 63. The carrier 63 has depending supporting abutments 64 at each end and a spring seat 65 extending downwardly from the carrier 63 to retain the upper end of a biasing switch spring 66 held in place within a recess of the housing 61. The carrier 63 is normally urged upwardly to a position as shown in FIG. 1 by the switch spring 66 and upper travel of the carrier 63 is limited by stops formed in the housing 61 and that engage the upper surface of the plunger 67.

It will be observed that the plunger 67 has been modified from that shown in the aforementioned Dehn et al U.S. Pat. No. 2,791,656. That is, the plunger 67 is adapted to receive a tubular retainer 68 extending thereabove. The tubular retainer 68 is preferably of a hardened metal material and contains at least one hardened steel ball, and preferably two steel balls 69 resting on a hardened steel wear plate 70. The retainer 68 is slightly pinched, crimped or otherwise provided with means for loosely retaining the uppermost ball 69 within the bore of the tubular retainer 68. This is not necessary to complete the invention, but does serve to minimize frustration in assembly caused by the balls dropping out of the retainer as the cam 23 and the uppermost ball 69 are positioned relative to one another. It will be further understood that the preferred embodiment includes the two cooperating balls for minimizing friction, but that, in certain instances, it may be desirable to provide only one ball.

It will be apparent that the balls 69 seated in the retainer 68 provide a direct acting cam follower which rises and falls with respect to the operating areas of the cam 23 to provide a means of actuating the switch 60 through operation of the plunger 67.

A thin resilient leaf spring 71 is inserted between the abutments 64 of the carrier of the carrier 63. The leaf spring 71 is of a length slightly greater than the distance between the abutments 64. Upon inserting the leaf spring 71, the abutments 64 are deflected slightly outwardly and the resilient leaf spring 71 is placed under compression and stressed beyond the point where bending occurs to assume a bowed configuration. Portions of the leaf spring 71 are cut away to form a pair of movable contact blades 72. The movable contact blades 72 are formed as a unitary whole with the leaf spring 71 and each is deflectable at its free end which mounts a movable contact 73.

A pair of upper fixed contacts 75 is disposed above the leaf spring 71 and a pair of lower fixed contacts 76 is disposed below the leaf spring 71. Contact terminals are provided to mount each of the stationary contacts 75 and 76.

In the absence of force exerted on the top of the plunger 67, the leaf spring 71 will be bowed downwardly (not shown) under the urging of the switch spring 66 and the movable contacts 73 will bear against the lower fixed contact 76 with the contact blades 72 deflected to provide contact force. When a downward force is applied to the top of the plunger 67, due to contact between the upper ball 69 and the raised node 25 as shown in FIG. 1, the plunger and carrier 63 will be urged to the lower position and in opposition to the urging of the switch spring 66. In this position, the leaf spring 71, as shown, will be bowed upwardly and the movable contacts 73 will press upon the upper fixed contacts 75 with the contact blades 72 deflected to provide contact force.

From the foregoing description of the cooperating elements of the present invention, it will be observed that manual rotational adjustment of the socket 36 and attendant rotation of its related dwell adjust shaft 35 will cause corresponding axial shifting of the cam 23 with respect to the stationary cam following roller or ball 69 on the switch 60, to thereby effectively alter the extent of the raised land surface or node 25 on the cam 23 as it is engaged by the upper ball 69.

Thus, considering the position of the upper ball 69 of the switch 60 to be initiated by depression of the switch plunger 67 from its position shown in FIGS. 1 and 2, the duration of switch "on" time can be regulated or variably adjusted according to the axial positioning of the cam 23 along sleeve 21. This function of axially shifting the cam 23 is reflected on the scale 48 as previously mentioned. It will be noted, for example, that in the position of the ball 69 and cam 23, shown in FIG. 1, the balls 69 are engaged with an uninterrupted end portion of the uniform cylindrical exterior surface of the cylindrical body portion 24 of the cam 23. Thus, the "on" time at that relative position between the cam and cam follower is zero, as reflected on the scale 48 and the related pointer arm 46 (see FIG. 2). Conversely, shifting of the cam means to the left, as viewed in FIG. 1, so that the uppermost ball 69 is in engagement with the uninterrupted depressed cylindrical surface portion 29 at the left-hand end of the cam 23, will produce 100% switch "on" time. Variations, of course, will be determined by the relative position between the ball 69 and the cam 23.

Axial movement of the cam 23 will be affected by the manual rotation of the hex socket 36, the shaft 35 and the threaded yoke 32 with its bifurcated arm portion 31 engaging the annular groove 30 in the cam 23.

The trim of the cam 23 with respect to the cam follower ball 69 for adjustable switch "on" time, as immediately above noted, is effectively coupled in the present device to the function of phase shifting the cam 23 with respect to the rotational movement of the input or drive shaft 16. Such phase shifting relationship is brought about by means of the "fast threaded" portion 20 at the right-hand end of the shaft 16 as viewed with respect to FIG. 1. The timing adjust sleeve 21 with its thread engaging means, such as the internally extending pin 22, in engagement with the threads of the portion 20 of the shaft 16 will be caused to move in an axial direction with respect to the shaft 16 by manual rotation of the hexagonal socket 44 of the timing adjust shaft 43. The threaded shaft 43 engages the threads of the yoke 42, which engages the groove 40 on the sleeve 21 by means of its bifurcated arm portion 41. Movement of the sleeve 21 with respect to the shaft 16 correspondently causes rotation of the cam 23 and consequent phase shifting of the cam 23 with respect to the shaft 16.

By this expedient, the point in time at which either of the riser portions 26 or 27 of the raised cam surfaces is presented to the cam follower ball 69 of the switch 60 may be accordingly advanced or retarded. In other words, the cam is phase shifted to alter shift operation except, of course, for such relative position of the cam follower ball 69 and the cam 23 as illustrated in FIG. 1, whereat the cam follower ball 69 engages a continuous uninterrupted surface of the cam 23.

From the foregoing description, it will be appreciated that the embodiment of the improved rotating cam limit switch described herein provides an effective means for controlling operation of an electrical switch means, both as to the point in time which a switch may be activated or deactivated in regard to a source of fixed cycle of motion applied to the input shaft 16. There is also provided an effective means for adjustably varying the duration of a given operating condition for the switch means, such as the degree of "on" or "off" time, according to the axial position of the cam 23 relative to its stationary follower 69. Such adjustments can obviously be made during rotational movement of the drive shaft 16.

As previously stated, the present functions may also be achieved as described in the Hendershot U.S. Pat. No. 3,465,269. The present invention takes advantage of the functional operation of that device and reduces various operating members of that device to their lowest common denominator. That is, rather than requiring five parallel shafts including continuously rotating shafts and adjustment shafts traversing the cavity length of the enclosure or housing 11, the shafts are reduced to three components. It will be readily observed that the single-shaft design (other than normally stationary adjustment shafts) promotes ease of assembly due to lack of critical multiple-shaft alignment problems. In addition, the present device eliminates a number of gears requiring great care in assembly of both the gears and the shafts to achieve proper alignment between members. Improper alignment may result in increased operating torque tending to shorten the life of a device.

Other prior art devices, such as the device described in the E. H. Kuhn U.S. Pat. No. 2,903,528, includes a multiplicity of cooperating parts and specially machined worm gear members, as well as cam members that are made of several pieces rather than combined into one cylindrical device as described herein. Similar adjustable rotating cam limit switches are also shown in the Cork et al U.S. Pat. No. 3,120,595 and the Hermale U.S. Pat. No. 3,483,344, each of which require specially machined parts of relatively complex and expensive construction.

It will be observed that, although a single switch assembly is shown and described herein, several of the assemblies may be arranged in side-by-side relationship where more than one switch and cam arrangement are desired. Each of the operating shafts may be simultaneously rotated by means of pulleys or meshing gear arrangements which are not herein shown and do not form a part of the present invention. Such arrangements are known and understood by those skilled in the art.

The embodiments of the invention in which an exclusive property or privilege is claimed are defined as follows:

1. A rotatable cam limit switch comprising in combination:

a housing member;

an electric switch in said housing and including a movable contact member and a cam follower arranged to move said contact member from a first operating position to a second operating position;

a drive shaft rotatably supported in said housing member;

a timing adjust sleeve circumjacent to said shaft and in threading engagement with said shaft for axial adjustment relative to said cam follower and said drive shaft;

an elongated, generally cylindrical, tubular cam having a bore receiving the external surface of said timing adjust sleeve and arranged for axial movement therealong and rotation therewith, said cam having a raised circumferential surface segment and a depressed circumferential surface segment, each segment extending substantially lengthwise of said cam and partially about the exterior thereof with the peripheral extent of each said segment varying from maximum to minimum between its ends, the surface segments of said cam means engaging said cam follower;

restraining means for preventing relative rotational movement between said timing adjust sleeve and said tubular cam;

dwell adjuster means for moving and maintaining said cam axially relative to said cam follower; and timing adjuster means for moving and maintaining said timing adjust sleeve axially relative to said cam follower and said drive shaft;

whereby the relative position between said cam and said cam follower on said switch may be selectively determined in accordance with the axial positioning of said cam relative to said drive shaft and the point in a given cycle of rotation of said cam at which said cam follower moves between said raised and depressed surface segments being selectively variable in accordance with the combined rotational adjustment of said cam and said sleeve relative to said drive shaft.

2. The rotatable cam limit switch as set forth in claim 1 wherein said drive shaft includes a threaded portion and said circumjacent timing adjust sleeve includes means for engaging the said threaded portion of said drive shaft to permit axial adjustment of said sleeve relative to said shaft responsive to movement of said timing adjust means.

3. The rotatable cam limit switch as set forth in claim 1 wherein the said threaded timing adjust sleeve includes an annular groove and the said timing adjuster means comprises a threaded yoke positioned on a manually adjustable threaded shaft and having a portion thereof engaging said annular groove for axially and rotatably shifting said sleeve relative to said drive shaft, and wherein said rotatable cam includes an annular groove and said dwell adjuster means comprises a yoke threadingly engaging a threaded shaft and having a portion thereof engaging said groove for axially shifting said cam axially relative to said sleeve and said shaft.

4. The rotatable cam limit switch as set forth in claim 2 wherein the threaded portion of said drive shaft comprises a thread having a linear pitch of approximately 1.80 inches for every 360° measured between centers of adjacent convolutions of said thread.

5. The rotatable cam limit switch as set forth in claim 4 wherein the said drive shaft includes as a portion thereof a threaded surface and said timing adjust sleeve includes an internally extending protrusion received by said threaded surface on said shaft.

6. The rotatable cam limit switch as set forth in claim 1 wherein the said restraining means comprises mating non-circular contoured surfaces externally of said timing adjust sleeve and internally of said tubular cam for preventing relative rotational movement between said sleeve and said cam.

7. The rotatable cam limit switch as set forth in claim 6 wherein said non-circular contour is in the form of a hexagon when viewed in cross section.

8. The rotatable cam limit switch as set forth in claim 1 wherein the cam follower on said switch comprises a laterally extending tubular member having seated in the bore thereof at least one rotatable ball axially slidable in said tubular member and engageable with the external surfaces of said cam at one side thereof and cooperating with switch operating mechanism at the other side thereof.

9. The rotatable cam limit switch as set forth in claim 8 wherein there are positioned two cooperating balls retained in said tubular member, with the uppermost ball engaging the cam surface and the lowermost ball seated intermediate the upper ball and a pressure plate on the actuating means of said switch.

10. A rotatable cam limit switch comprising in combination:

a housing member;

an electric switch in said housing and including a movable contact member and a cam follower arranged to move said contact member from a first operating position to a second operating position;

a drive shaft rotatably supported in said housing member, said drive shaft including a threaded portion rotatable therewith;

a timing adjust sleeve circumjacent to said shaft and including thread engaging means for engagement with said threaded portion of said drive shaft, the external surface of said sleeve having a uniform, non-circular cross section along at least a portion of its length;

an elongated, generally cylindrical, tubular cam having a non-circular longitudinal bore receiving the external surface of said timing adjust sleeve and arranged for axial movement therealong and rotation therewith, said cam having a raised circumferential surface segment and a depressed circumferential surface segment, each segment extending substantially lengthwise of said cam and partially about the exterior thereof with the peripheral extent of each said segment varying from maximum to minimum between its ends, the surface segments of said cam means engaging said cam follower;

a threaded timing adjuster shaft rotatably supported in said housing in parallel relationship with said drive shaft;

yoke means carried by and threadingly engaged with said timing adjuster shaft and movable therealong responsive to manual rotation thereof, said yoke means having an arm portion engageable with said timing adjust sleeve for moving the latter axially along the threaded portion of said drive shaft, thereby to effect relative rotation between said sleeve, said drive shaft and said timing adjuster shaft;

a threaded dwell adjust shaft rotatably supported in said housing in parallel relationship with said drive shaft; and second yoke means carried by and threadingly engaged with said dwell adjust shaft and movable therealong responsive to manual rotation thereof, said second yoke means having an arm portion engageable with said tubular, generally cylindrical cam means for moving the latter axially along the external surface of said timing adjust sleeve;

whereby the relative position between said cam and said cam follower on said switch may be selectively determined in accordance with the axial positioning of said cam on said timing adjust sleeve and the point in a given cycle of rotation of said cam at which said cam follower moves between said raised and depressed surface segments being selectively variable in accordance with the rotational adjustment of said cam and sleeve relative to said drive shaft.

11. In a rotatable cam limit switch comprising in combination:

a housing member;

an electric switch in said housing and including a movable contact member and a cam follower arranged to move said contact member from a first operating position to a second operating position;

a drive shaft rotatably supported in said housing member, an elongated, generally cylindrical, rotatable cam arranged for axial movement relative to said cam follower, said cam having a raised circumferential surface segment and a depressed circumferential surface segment, each segment extending substantially lengthwise of said cam and partially about the exterior thereof with the peripheral extent of each said segment varying from maximum to minimum between its ends, the surface segments of said cam means engaging said cam follower;

timing adjust means for rotatably shifting said cam axially relative to said drive shaft and said cam follower;

dwell adjust means for moving and maintaining said cam axially relative to said cam follower; and whereby the relative position between said cam and said cam follower on said switch may be selectively determined in accordance with the axial positioning of said cam relative to said drive shaft and the point in a given cycle of rotation of said cam at which said cam follower moves between said raised and depressed surface segments being selectively variable in accordance with the rotational adjustment of said cam and said sleeve relative to said drive shaft;

the improvement wherein said drive shaft, said timing adjust means and said cam are combined as a unitized assembly including;

a timing adjust sleeve circumjacent to said shaft and in threading engagement with said shaft for axial adjustment relative to said cam follower and said drive shaft; and said cam having a tubular bore receiving the external surface of said timing adjust sleeve and arranged for axial movement therealong and rotation therewith.

* * * * *